United States Patent [19]

Weidler et al.

[11] 4,212,563

[45] Jul. 15, 1980

[54] RUPTURABLE CLOSURE PLUG FOR OFFSHORE STRUCTURES

[75] Inventors: Jay B. Weidler; Bert E. Gracia, both of Houston; Tommy L. Hull, Sugarland, all of Tex.

[73] Assignee: Brown & Root, Inc., Houston, Tex.

[21] Appl. No.: 974,427

[22] Filed: Dec. 29, 1978

[51] Int. Cl.[2] ..... E02B 17/00

[52] U.S. Cl. ..... 405/195; 405/227

[58] Field of Search ..... 405/195, 203, 208, 224, 405/225, 227, 232; 138/89, 96 R, 109; 220/266

[56] References Cited

U.S. PATENT DOCUMENTS

| | | | |
|---|---|---|---|
| 2,979,910 | 4/1961 | Crake | 405/208 |
| 3,315,473 | 4/1967 | Hauber et al. | 405/227 |
| 3,338,058 | 8/1967 | Young | 405/195 X |
| 3,474,630 | 10/1969 | Pogonowski | 405/195 |
| 3,512,811 | 5/1970 | Bardgette et al. | 405/227 X |
| 3,533,241 | 10/1970 | Bowerman et al. | 405/225 |
| 3,613,381 | 10/1971 | Cox | 405/206 |
| 4,047,391 | 9/1977 | Mayfield et al. | 405/225 |
| 4,146,180 | 3/1979 | Frosch et al. | 220/266 X |

FOREIGN PATENT DOCUMENTS

| | | | |
|---|---|---|---|
| 1468507 | 3/1977 | United Kingdom | 405/227 |

*Primary Examiner*—David H. Corbin

*Attorney, Agent, or Firm*—Kenway & Jenney

[57] ABSTRACT

An offshore structure comprises a jacket having buoyant compartments defined by a jacket leg. A rupturable closure defines a lower end of the buoyant compartment. The rupturable closure is operable to be ruptured by a pile impacting on an upper side thereof. The rupturable closure comprises a cup-like cap having a convex under side, and a concave upper side. A plurality of circumferentially spaced, generally radially extending weakened zones in the cap are operable to define generally radially extending rupture zones when the cap is impacted by a pile on its concave upper side. The cup-like cap, when impacted by the pile, ruptures along the generally radially extending weakened zones to define a plurality of triangular cap segments. The generally triangular cap segments are pressed generally radially outwardly of the central axis of the leg toward the inner periphery of the jacket leg by the impacting pile.

13 Claims, 11 Drawing Figures

FIG. 2
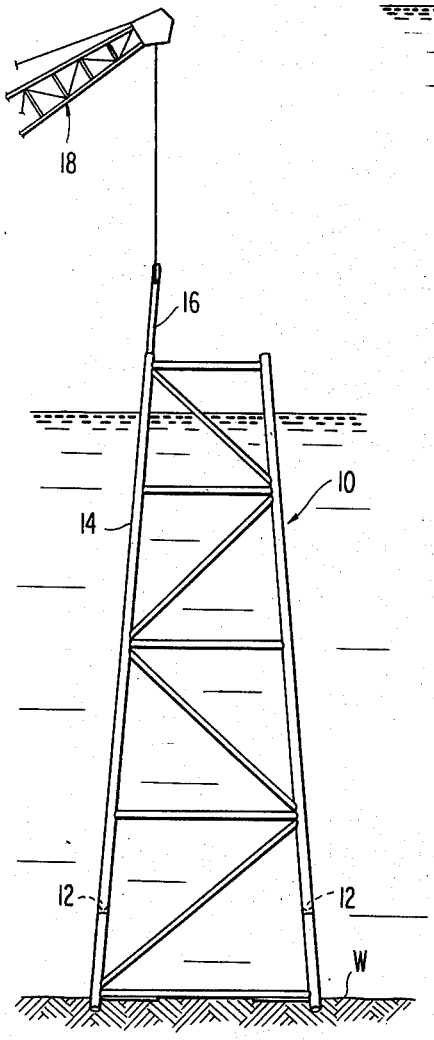
FIG. 1
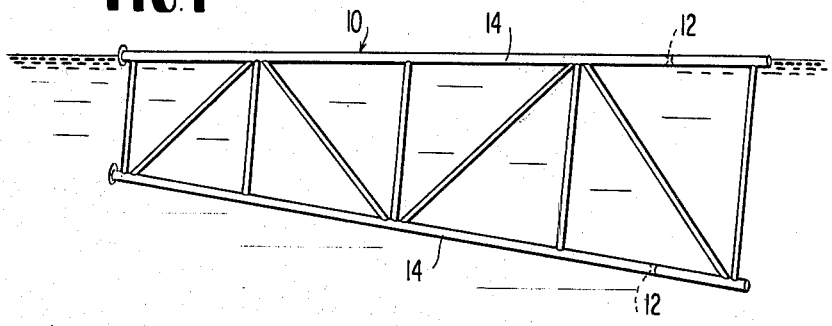
FIG. 3
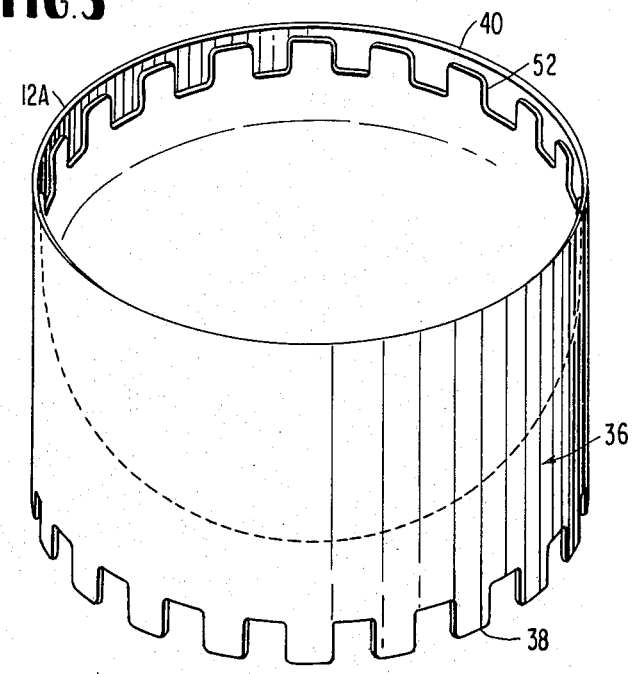
FIG. 4
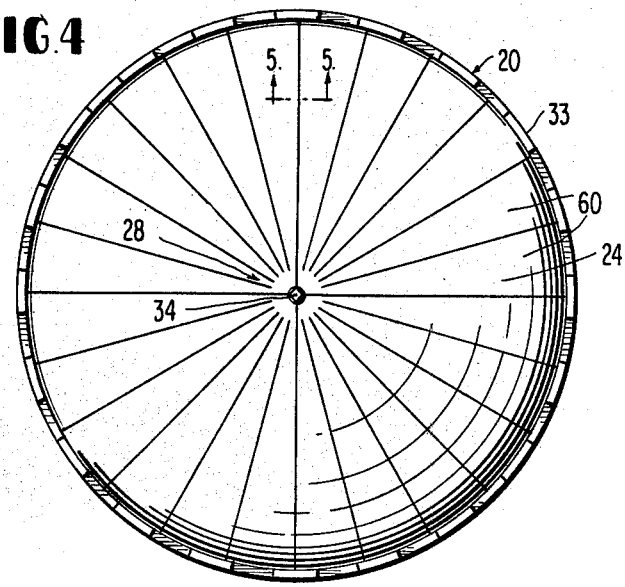
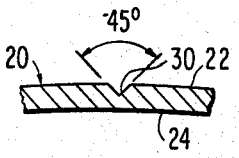
FIG. 5

70
88
76
82

16
94
84
86
90
88
92
70
76
14
34

70
72
76
80
78
74

14
34
94
88
72
74
70
76
82
16

RUPTURABLE CLOSURE PLUG FOR OFFSHORE STRUCTURES

BACKGROUND AND OBJECTS OF THE INVENTION

The present invention relates to offshore structures and, more particularly, to rupturable plugs or closures situated within hollow columns or legs of offshore platform-supporting jackets.

Offshore activities, such as oil and gas exploration and recovery operations for example, are generally performed from offshore platforms which are supported above the water surface upon large upright jacket structures. A support jacket may comprise a plurality of upstanding hollow columns or legs which are anchored to the water bed. Fabrication of the jacket is performed on shore, and thereafter the jacket is floated to the work site for erection in the water. Eventually, a work platform is positioned on the jacket.

In order to render the jacket legs suitably buoyant to be floated, buoyant compartments or chambers are created therewithin, usually by means of temporary plugs or closures which are affixed within the jacket legs. Erection of the jacket at the work site is performed by a selective flooding of the buoyant compartments. Thereafter, piles are inserted into the hollow legs and are driven into the water bed to firmly anchor the jacket in place. In order to accomodate the piles, upper ones of the closures can be removed manually, but lower ones of the closures are relatively inaccessible. It has, therefore, been proposed to impact the piles against rigid planar lower closures such that the latter are ruptured. However, this procedure may result in the formation of closure fragments which thereafter obstruct further downward travel of the pile and/or may interfere with entry of the pile into the water bed. Exemplary of this type of arrangement are the disclosures in U.S. Pat. No. 2,979,910 issued to Crake on Apr. 18, 1961; U.S. Pat. No. 3,315,473 issued to Hauber et al on Apr. 25, 1967; and U.S. Pat. No. 3,474,630 issued to Pogonowski on Oct. 28, 1969. In the disclosure of the Crake patent, planar plates are secured across the lower ends of the jacket legs and are pierced by piles that are driven through the legs. The Hauber et al patent discloses bottom cover plates for the jacket legs which are pierced by the beveled ends of piles which are dropped through the legs. The Pogonowski patent discloses the use of bulkheads within the jacket legs which each include a planar frangable plate and a tapered guide ring for guiding a fluid conduit which is dropped through the leg so that the conduit properly fractures the frangable plate.

In lieu of a rigid rupturable plate, there has been heretofore proposed the use of flexible diaphragms which are ruptured by the pile. However, such diaphragms require that separable flanges be provided for clamping the outer edges of the diaphragm. Exemplary of such proposals are U.S. Pat. No. 3,533,241 issued to Bowerman et al on Oct. 13, 1971 and U.S. Pat. No. 4,047,391 issued to Mayfield et al on Sept. 13, 1977. In each of those patents a rubber diaphragm is clamped at its outer edge between separable flanges. In order to center the pile within the jacket leg, a guide ring is secured within the leg and includes inwardly and downwardly inclined guide surfaces.

Another form of closure is described in U.S. Pat. No. 3,613,381 issued to Cox on Oct. 19, 1971. In the disclosure of that patent, a closure member is welded within the lower end of a jacket leg. The closure member comprises a frusto conical element whose convex surface faces upwardly, and a removal arm which is welded to the frusto conical element. A chain is connected to the removal arm and can be pulled from a location above the jacket leg to cause the frusto conical element to be torn away from the jacket leg for removal therefrom prior to installation of the pile. Closures of this type are relatively expensive to fabricate and require that connection between the removal arm and the top of the jacket leg be maintained.

It is, therefore, an object of the present invention to minimize or obviate problems of the type discussed above.

It is another object of the invention to provide a novel closure for offshore jacket legs.

It is a further object of the invention to enable closures in offshore jacket legs to be effectively ruptured by a pile without thereafter obstructing downward travel of the pile.

It is an additional object of the present invention to provide a novel closure for offshore jacket legs, which closure is ruptured by a pile such that the resulting rupture segments of the closure are displaced to non-obstrucing positions within the jacket leg.

It is a further object of the invention to provide a novel closure for an offshore jacket leg which comprises a downwardly convex member having radial score lines which promote a rupturing of the closure in response to impact by a pile such that the resulting rupture segments remain affixed to the inside wall of the jacket leg and extend longitudinally between the pile and jacket leg.

BRIEF SUMMARY OF THE INVENTION

These objects are achieved by the present invention wherein an offshore jacket structure comprises buoyant compartments defined by a jacket leg. Rupturable closure means define a lower end of each buoyant compartment. The rupturable closure is operable to be ruptured by a pile impacting on an upper side thereof, when the jacket leg is in a generally upright orientation. The rupturable closure comprises a cup-like cap having a convex under side, and a concave upper side. A plurality of circumferentially spaced, generally radially extending weakened zones in the cap are operable to define generally radially extending rupture zones when the cap is impacted on its concave upper side by a pile. The cup-like cap, when impacted by the pile, ruptures along the generally radially extending weakened zones to define a plurality of triangular cap segments. The generally triangular cap segments are pressed generally radially outwardly of the central axis of the leg toward the inner periphery of the jacket leg by the impacting pile.

THE DRAWINGS

These and other advantages of the invention will become apparent from the following detailed description of a preferred embodiment thereof in connection with the accompanying drawings in which like numerals designate like elements and in which:

FIG. 1 is a side elevational view depicting a floating offshore jacket being tilted toward an upright posture in the water;

FIG. 2 is a side elevational view of the jacket once it has been turned upright and rests on the water bed, with a pile being lowered into a leg of the jacket by a crane;

FIG. 3 is a perspective view of a mounting sleeve in accordance with one preferred embodiment of the invention;

FIG. 4 is a bottom view of a cup-shaped closure cap according to the present invention;

FIG. 5 is a sectional view taken along line 5—5 of FIG. 4 depicting the cross-sectional shape of score lines disposed in the cap;

DETAILED DESCRIPTION OF PREFERRED EMBODIMENTS OF THE INVENTION

Figure 7:
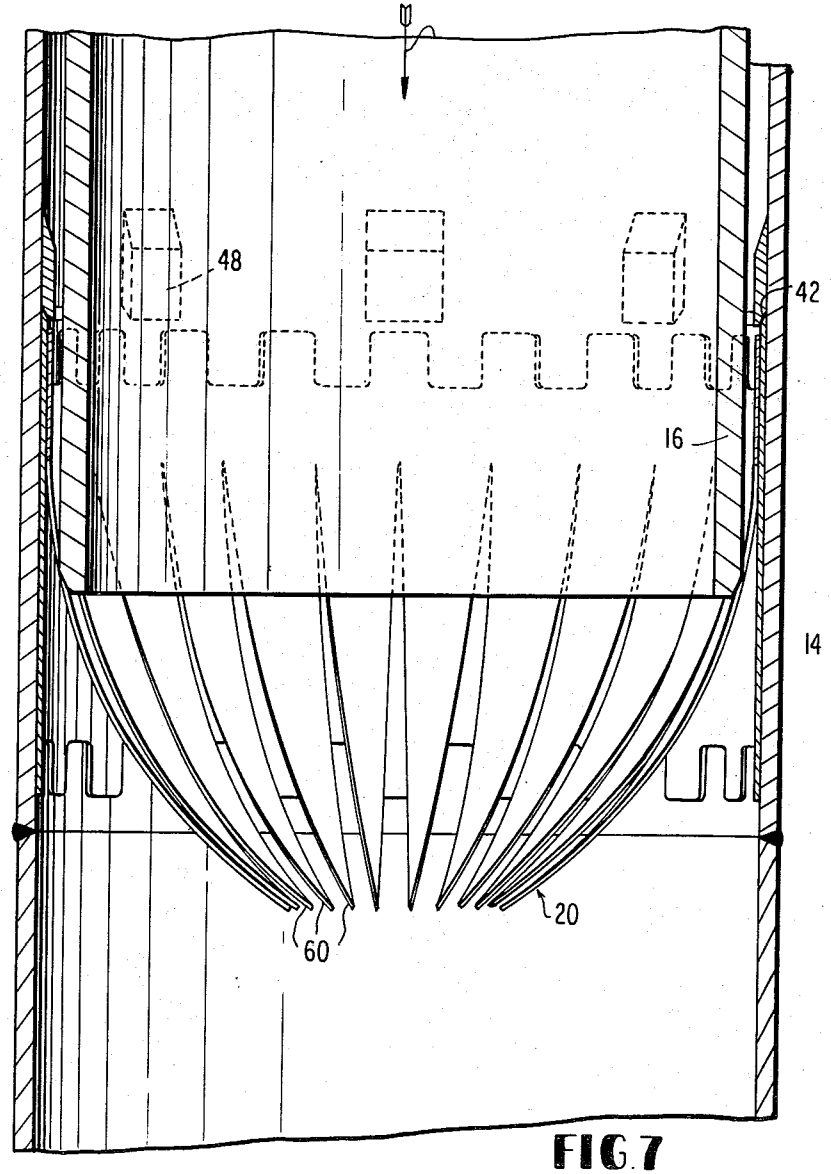
FIG. 7 is a view similar to FIG. 6 depicting the ruptured condition of the cap after being impacted against by a pile.
Figure 6:
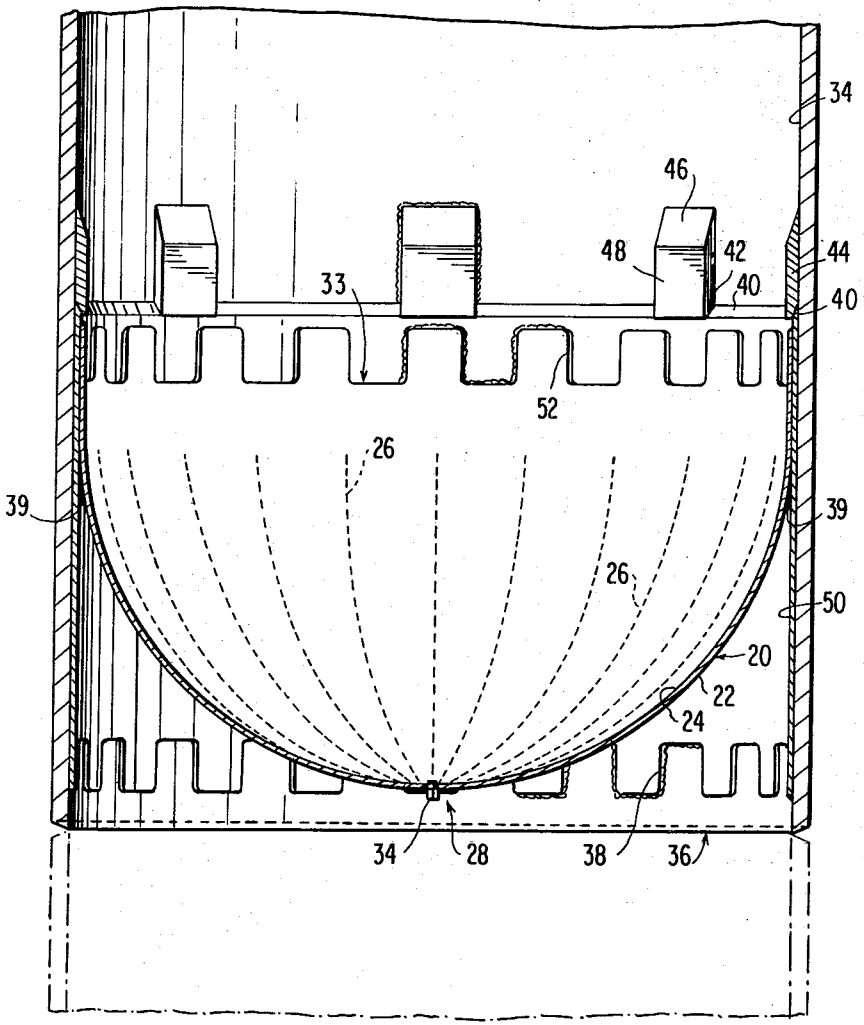
FIG. 6 is a longitudinal sectional view taken through a jacket leg depicting the closure cap in its mounted position.
Figures 8, 9, 10, 11:
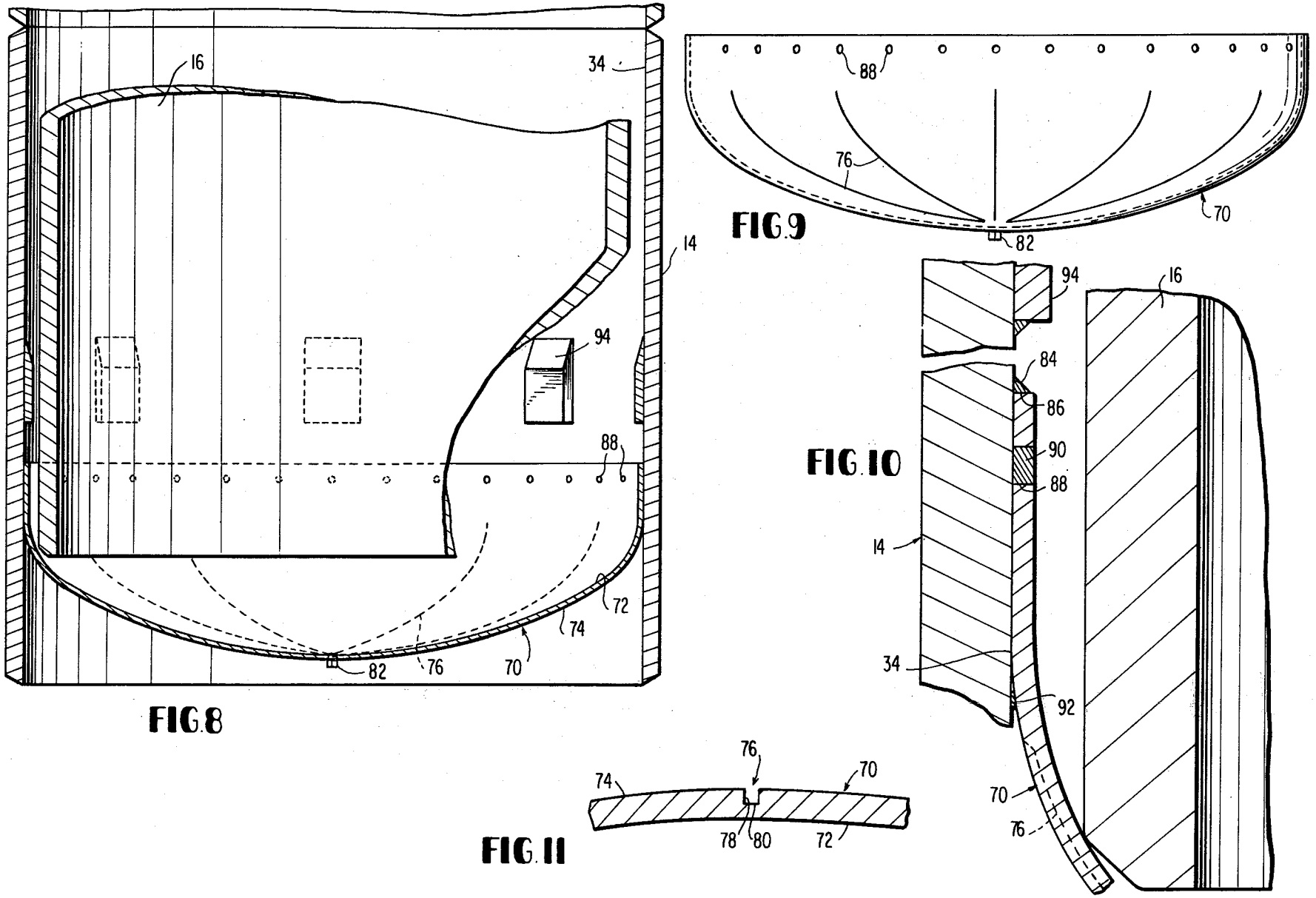
FIG. 8 is a longitudinal sectional view taken through a jacket leg depicting the arrangement of another preferred closure cap according to the invention, about to be impacted by a pile.
FIG. 9 is a side elevational view of the closure cap depicted in FIG. 8.
FIG. 10 is an enlarged, fragmental view of FIG. 8, depicting the manner in which the closure cap is directly connected to an inside wall of the jacket leg.
FIG. 11 is a cross-sectional view taken through a score line in the closure cap of FIG. 9.

In FIG. 1 there is schematically depicted a floating offshore jacket 10 in the process of being tipped toward an upright orientation depicted in FIG. 2. The jacket comprises temporary bottom closures 12 in accordance with the present invention which cooperate with other closures (not shown) to define buoyancy compartments within hollow columns or legs 14 of the jacket. Those compartments are selectively flooded in order to cause the jacket to rotate from a horizontal orientation to the upright, erected orientation depicted in FIG. 2. Details of the jacket construction and erecting procedure may be found in U.S. Pat. No. 3,585,801 issued to Koehler on June 22, 1971, and assigned to the assignee of the present invention.

After the jacket has been lowered onto the waterbed W, temporary closures located at upper ends of the jackets are removed in suitable fashion and piles 16 are introduced into the upper ends of the legs by a barge-mounted crane 18. The piles travel through the lower temporary closures 12 in the jacket legs 14 and thereafter are driven into the waterbed and are suitably grouted in place in conventional fashion.

In accordance with the present invention the lower closures 12 are formed in such manner that once having been ruptured by the piles, they offer no appreciable resistance to continued downward travel of the piles, or entry of the piles into the waterbed.

One preferred form of closure 12A is illustrated in FIGS. 3–7 and comprises a cup-shaped cap 20 which can be fashioned from a single sheet of metal (e.g., steel) as by forging for example. The cup-shaped cap 20 includes a convex under side 22 and a concave upper side 24. The cap 20 has a semi-elliptical cross section extending longitudinally of the leg 14. Other suitable configurations may be employed which provide a concave upper side, such as frustoconical or parabaloid configurations for example.

Located preferably on the under side 22 of the cap 20 are a plurality of circumferentially spaced weakened zones 26 which extend generally radially relative to a lower apex 28 of the cap 20. As will be described, the weakened zones 26 define rupture zones which promote rupturing of the cap by an impacting pile.

The weakened zones 26 are preferably defined by score lines or score grooves 30 which may be of any suitable configuration, such as a 45° V groove as depicted in FIG. 5.

At the apex 28 a small aperture 32 is provided which induces rupturing of radially inner portions of the cap. A plug 34 of any suitable type is secured within the aperture, as by a screw thread connection for example, until rupturing of the closure occurs, to render the cap fluid tight in defining a buoyancy compartment thereabove within the jacket leg 14.

Most of the score channels 30 terminate short of the aperture 32, although four of the score channels 30A, mutually spaced by 90°, extend all the way to the aperture 32. The upper ends of the score channels 30 terminate short of the upper edge 33 of the cap 20. In the preferred embodiment the score channels 30 are spaced by 15 degrees.

In the embodiment of the invention disclosed in connection with FIGS. 3–7, the cap 20 is mounted to the jacket leg 14 via an intermediate mounting sleeve 36. However, it may be preferrable to omit the sleeve 36 and connect the cap directly to the inside wall of the jacket leg, as will be discussed subsequently in connection with FIGS. 8–11.

The sleeve 36 comprises a generally cylindrical metallic member which is interposed between the outer periphery of the cap 20 and the inner wall 34 of the jacket leg 14 in circumscribing relationship to the cap.

Preferably, the sleeve 36 is welded to the inner wall 34 of the leg. Welding can be facilitated by forming the lower edge 38 of the sleeve of saw-tooth design to increase the length of the weld bead.

Jacket legs of the type presently described are of sufficient cross-sectional size (e.g., four feet in diameter for example) to accomodate a workman.

An annular weld bead 39 is applied between the under side 22 of the cap and the inside wall 34 of the jacket leg to provide a fluid seal therebetween.

An upper edge 40 of the sleeve is beveled inwardly and is positioned behind correspondingly beveled edges 42 of a plurality of circumferentially spaced guide bars 44 which are welded to the inner wall 34 of the jacket leg 14. In this fashion, the upper edge 40 of the sleeve 36 may be positioned behind the centering bars 44 before the lower edge 38 of the sleeve is welded to the jacket leg.

The guide bars 44 each include a downwardly and inwardly tapering guide surface 46 and a downwardly extending centering surface 48. The guide surfaces 46 are oriented to direct a downwardly traveling pile 16 toward a centered position within the jacket leg 14, such centered position of the pile being maintained by the centering surfaces 48 (FIG. 7).

The cap 20 is preferably welded at its upper end to an inner wall 50 of the sleeve 36. Welding can be facilitated by forming the upper edge 52 of the cap 20 of saw-tooth design to maximize the length of the weld bead and to enable the weld to be applied from below rather than from above.

The connection between the upper end of the cap 20 and the sleeve 36 defines a fulcrum about which the segments of the cap can bend, as will be subsequently explained.

In operation, the cap 20 and the sleeve 36 are welded together and then such assembly is installed in the jacket leg prior to floating of the jacket 10 to the work site. The closure 12A is water tight and defines the bottom of a buoyancy compartment thereabove within the jacket leg. Once the jacket has been submerged in upright fashion on the waterbed (as depicted in FIG. 1), upper closure caps in the jacket legs are removed in suitable fashion, and the piles 16 are dropped through the jacket legs. The guide bars 44 assure that the descending pile 16 is centered within the associated jacket leg when it impacts against the upper side 24 of the cap 20.

The impacting of the pile against the cap upper side 24 causes the cap to rupture at the aperture 30 and along the weakened zones 24 to form a plurality of triangular cap segments 60 (FIG. 7). The cap segments 60 bend downwardly about the fulcrum defined by their upper connection with the jacket leg and are pressed radially outwardly of the central axis of the jacket leg toward the inner wall of the leg by the pile. The bent segments extend substantially longitudinally within the jacket leg 14. The bending fulcrum of the segments 60 is spaced radially outwardly of the outer surface 62 of the pile 16. It will thus be appreciated that no appreciable resistance is exerted by the cap segments to continued downward travel of the pile. Moreover, the segments cannot fall ahead of the pile so as to form an obstacle to entry of the pile within the waterbed.

It will be appreciated that, if desired, any other closures which are positioned within the jacket leg above the lower closures 12, can be formed in accordance with the present invention so as to be ruptured by the pile.

As noted earlier, it may be preferable to omit the sleeve 36 and connect the upper end of the cap 20 directly to the jacket leg. In FIGS. 8–11 such a cap 70 is disclosed. The cap 70 is basically similar to the cap 20 described above in that it is of semi-elliptical configuration, having a concave upper side 72, a convex under side 74, and a series of score channels 76 formed in the under side 74. The score channels 76 are preferably of U-shaped cross section, having parallel side walls 78 and a perpendicular base 80. The score channels 76 converge toward a lower aperture in the cap 70 which is closed by a plug 82.

The upper end of the cap 70 is welded directly to the inner wall 34 of the jacket leg. This is achieved by means of a filet weld 84 extending around the upper most edge 86 of the cap 70. Also, circumferentially spaced holes 88 are provided in the cap 70 below the edge 86, each of which holes may receive a plug weld 90. An annular weld bead 92 is applied between the under side 74 of the cap 70 and the inside wall 34 of the jacket leg 14 to form a fluid seal.

The cap 70 is installed below the bottom ends of a plurality of guide bars 94, the latter serving to center a pile 16 as it descends through the jacket leg 14.

Operation of the cap 70 is similar to that of the cap 20. As the pile 16 descends through the jacket leg 14, it is centered by the guide bars 94 and impacts against the concave upper side of the cap 70, thereby causing the cap to rupture at the lower aperture and along weakend zones defined by the score channels 76. As a result, the cap 70 is ruptured to form a plurality of triangular cap segments which are bent about their weld connection with the jacket leg, which weld connection is spaced outwardly from the pile. The segments remain connected to the inner wall of the jacket leg.

SUMMARY OF MAJOR ADVANTAGES AND SCOPE OF THE INVENTION

It will be appreciated that the closure cap provided by the present invention is inexpensive to manufacture and may be conveniently installed within a jacket leg without the need for separable clamping flanges for installation. The score lines facilitate rupturing of the cap into pre-established shapes. After being ruptured the cap segments remain connected to the jacket leg and are easily bent downwardly by the pile. The fulcrum about which the cap segments bend is spaced outwardly of the pile. The cap segments exert no appreciable resistance to continued downward movement of the pile, nor do they interfere with entry of the pile into the Waterbed.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. An offshore structure comprising:

jacket means including buoyant compartment means defined by jacket leg means;

rupturable closure means defining lower end means of said buoyant compartment means, said rupturable closure means being operable to be ruptured by pile means impacting on upper side means thereof, when said jacket leg means are in a generally upright orientation;

the improvement in said rupturable closure means comprising:

cup-like cap means defining said rupturable closure means and having convex under side means, and concave upper side means;

a plurality of circumferentially spaced, generally radially extending weakened zones in said cap means operable to define generally radially extending rupture zones when said cap means is impacted on said concave upper side by pile means; and said cup-like cap means, when impacted by said pile means, rupturing along said generally radially extending weakened zones to define a plurality of generally triangular cap segments, with said generally triangular cap segments being pressed generally radially outwardly of the central axis of said leg means toward the inner periphery of said jacket leg means by said impacting pile means.

2. An offshore structure as described in claim 1 wherein:

said structure includes pile guide means operable to guide said impacting pile means into the interior of said concave upper side of said cup-like cap means; and said structure further includes generally annular fulcrum means peripherally circumscribing said cup-like cap means and interposed between the outer periphery of said cap means and the interior of said jacket leg means and operable to define bending fulcrum means at the upper ends of said generally triangular segments.

3. An offshore structure as described in claim 2 wherein:

said fulcrum means comprises a cylindrical sleeve connected to an inner wall of said jacket leg means, the upper end of said cap being connected to an inside wall of said sleeve and spaced radially outwardly of the pile means as the latter passes therethrough.

4. An offshore structure as defined in claim 3 further including:

centering means mounted within said jacket leg means for centering the pile longitudinally within said jacket leg means, the upper edge of said sleeve being disposed between a lower edge of said centering means and the inside wall of said jacket leg means.

5. An offshore structure as described in claim 1 wherein:

said apparatus further includes rupture-facilitating aperature means located generally centrally of said cup-like cap means with plug means closing said aperature means.

6. An offshore structure as described in claim 1 wherein:

said cap means is welded directly to an inner wall of said jacket leg means, said upper end of said cap means spaced radially outwardly of the pile means as the latter passes therethrough.

7. An offshore structure as described in claim 1 wherein:

said weakened zones are defined by score channels in said cup means.

8. An offshore structure as described in claim 1 wherein:

said cup-like cap means has a generally semi-elliptical cross section, extending longitudinally of said jacket leg means.

9. In an offshore structure comprising:

jacket means including buoyant compartment means defined by jacket leg means; and rupturable closure means defining lower end means of said buoyant compartment means, said rupturable closure means being operable to be ruptured by pile means impacting on upper side means thereof, when said jacket leg means is in a generally upright orientation;

the improvement in said rupturable closure means comprising:

cup-like cap means defining said rupturable closure means and having convex under side means, and concave upper side means; and a plurality of circumferentially spaced generally radially extending weakened regions formed on said cap means and operable to define rupture zones when said cap means is impacted on said concave upper side by pile means; and said cup-like cap means, when impacted by said pile means, rupturing along said weakened zones to define a plurality of rupture segments, with said rupture segments being pressed generally downwardly and outwardly of the central longitudinal axis of said leg means toward the inner periphery of said jacket leg means by said impacting pile means.

10. An offshore structure as described in claim 9 wherein said structure includes:

pile guide means operable to guide said impacting pile means into the interior of said concave upper side of said cup-like cap means; and rupture inducing aperture means disposed at the lower apex of said cap means, when said jacket leg means is in said generally upright orientation and operable to induce rupturing of radially inner portions of said weakened zones, generally concurrently with rupturing of radially outer portions of said weakened zones, caused by impacting engagement of said pile means with the interior of said concave upper side means of said cup-like cap means, generally adjacent said radially outer portions of said weakened zones.

11. An offshore structure as described in claim 10 wherein:

said cup-like cap means has a generally semi-elliptical cross section, as defined by cross sectional planes extending generally longitudinally of said jacket leg means.

12. An offshorestructure as described in claim 9 wherein:

said cup-like cap means has a generally semi-elliptical cross section, as defined by cross sectional planes extending generally longitudinally of said jacket leg means.

13. An offshore structure comprising:

jacket means including buoyant compartment means defined by jacket leg means; and rupturable closure means defining lower end means of said buoyant compartment means, said rupturable closure means being operable to be ruptured by pile means impacting on upper side means thereof, when said jacket leg means is in a generally upright orientation;

the improvement in said rupturable closure means comprising:

cup-like cap means defining said rupturable closure means and having convex under side means, and concave upper side means;

a plurality of circumferentially spaced, generally radially extending weakened zones operable to define generally radially extending rupture zones when said cap means is impacted on said concave upper side by pile means impacting thereon; and said cup-like cap means, when impacted by said pile means, rupturing along said generally radially extending weakened zones to define a plurality of generally triangular cap segments, with said generally triangular cap segments being pressed generally radially outwardly of the central axis of said leg means toward the inner periphery of said jacket leg means by said impacting pile means; and rupture inducing aperture means disposed at the lower apex of said cap means and passing generally axially therethrough, when said jacket leg means is in said generally upright orientation, and operable to induce rupturing of radially inner portions of said weakened zones in response to impacting engagement of said pile means with the interior of said upper side means of said cup-like cap means.

* * * * *